US005234572A

United States Patent [19]

Uchida et al.

[11] Patent Number: 5,234,572

[45] Date of Patent: Aug. 10, 1993

[54] METAL ION REPLENISHMENT TO PLATING BATH

[75] Inventors: Hiroki Uchida; Motonobu Kubo; Masayuki Kiso; Teruyuki Hotta; Tohru Kamitamari, all of Hirakata, Japan

[73] Assignee: C. Uyemura & Co., Ltd., Osaka, Japan

[21] Appl. No.: 911,076

[22] Filed: Jul. 9, 1992

[30] Foreign Application Priority Data

Jul. 9, 1991 [JP] Japan ..... 3-194746

[51] Int. Cl.[5] ..... C25D 21/18

[52] U.S. Cl. ..... 205/101; 204/153.1; 204/400; 205/96; 205/83

[58] Field of Search ..... 205/101, 83, 96, 97; 204/DIG. 13, 434, 153.1, 400

[56] References Cited

U.S. PATENT DOCUMENTS 4,514,266 4/1985 Cole et al. ..... 205/101
4,789,439 12/1988 Bunk et al. ..... 205/101
5,173,170 12/1992 Brown et al. ..... 205/101

FOREIGN PATENT DOCUMENTS 0268823 6/1988 European Pat. Off. .
57171699 4/1987 Japan .

OTHER PUBLICATIONS

Patent Abstract of Japan, vol. 6, No. 257 (C-140) (1135) Dec. 16, 1982 & JP-A-57 149 498 (DIPSOL KK) Sep. 16, 1982.

*Primary Examiner*—John Niebling
*Assistant Examiner*—Brian M. Bolam
*Attorney, Agent, or Firm*—Birch, Stewart, Kolasch & Birch

[57] ABSTRACT

For replenishing a metal ion to a plating bath, a soluble electrode of the same type of metal as in the bath and a counter electrode of a metal material having a nobler standard electrode potential than the soluble electrode are immersed in the bath. Electricity is conducted between the soluble electrode and the counter electrode, thereby dissolving the soluble electrode to replenish an ion of the metal of the soluble electrode to the bath. The potential of the counter electrode is measured using a reference electrode of the same metal as the soluble electrode. The quantity of electricity is controlled such that the measured potential may not be negative with respect to the reference electrode, thereby preventing deposition of the dissolving metal ion on the counter electrode while ensuring a high rate of metal ion dissolution.

2 Claims, 2 Drawing Sheets

METAL ION REPLENISHMENT TO PLATING BATH

This invention relates to a method for replenishing a metal ion to a plating bath, and more particularly, to a method for replenishing a metal ion to a plating bath by immersing a soluble electrode and an insoluble electrode having a nobler standard electrode potential and conducting electricity between the electrodes, thereby dissolving and supplying a metal ion from the soluble electrode to the bath.

BACKGROUND OF THE INVENTION

Metal ion replenishment techniques of this type are known in the art. One typical technique is disclosed in Japanese Patent Application Kokai No. 171699/1982 as comprising immersing one metal to be plated and another metal having a nobler standard electrode potential than the one metal in the plating bath and electrically coupling them, thereby dissolving the one metal into the bath as an ion in accordance with the principle of electrochemical cell. This technique uses platinum, gold or a similar metal element as the other metal having a nobler standard electrode potential. We found that the use of such a noble metal element electrode as the counter electrode is not fully effective in practice because of a slow rate of dissolution of metal from the soluble electrode.

In order to increase the rate of dissolution of metal from the soluble electrode, we found that the dissolution rate can be increased by a factor of 2 or more by using an electrode having a platinum group metal oxide on a surface as the counter electrode. We then proposed in Japanese Patent Application No. 318296/1989 a new method for replenishing metal ion to a plating bath in accordance with the principle of an electrochemical cell in which an electrode having a platinum group metal oxide on a surface is used as the counter electrode to the soluble electrode.

Higher rates of replenishment of metal ion to the plating bath provide many advantages, including the reduced volume of a dissolving tank. Therefore, there is a desire for further increasing the rate of replenishment of metal ion, that is, the rate of dissolution of metal ion from the soluble electrode.

SUMMARY OF THE INVENTION

An object of the present invention is to provide a novel and improved method for replenishing a metal ion to a plating bath at a higher rate.

In accordance with a method for replenishing a metal ion to a plating bath according to the present invention, a soluble electrode of the same type of metal as in the bath is immersed in the bath. A counter electrode of a metal material having a nobler standard electrode potential than the soluble electrode is also immersed in the bath. Electricity is conductive between the soluble electrode and the counter electrode, thereby dissolving the soluble electrode to replenish an ion of the metal of the soluble electrode to the bath. The potential of the counter electrode is measured using a reference electrode of the same metal as the soluble electrode. The quantity of electricity conducted between the soluble electrode and the counter electrode is controlled such that the measured potential may not be negative with respect to the reference electrode, thereby preventing deposition of the dissolving metal ion on the counter electrode.

More particularly, in connection with the technique wherein the soluble electrode of the metal to be fed into the plating bath and the counter electrode are immersed in the bath and electrochemical interaction occurs among the electrodes and the plating solution whereby the metal in ion form is released and fed from the soluble electrode into the bath, it is desired to increase the quantity and rate of release of metal ion. To this end, it would occur to those skilled in the art to conduct electricity between the soluble electrode and the counter electrode to ensure the dissolution and release of metal on form the soluble electrode. Since there arose a problem that the counter electrode was plated as a result of electric conduction, it was difficult in practice to effectively dissolve and supply a metal ion to the bath. Taking this problem into account, we investigated how to prevent the plating of the counter electrode when electricity was conducted between the soluble electrode and the counter electrode in order to increase the quantity and rate of dissolution of metal ion from the soluble electrode. We have found that by measuring the potential of the counter electrode using a reference electrode of the same metal material as the soluble electrode, and controlling the quantity of electricity conducted between the soluble electrode and the counter electrode such that the measured potential may not be negative with respect to the reference electrode, the deposition of the dissolving metal ion on the counter electrode is prevented while an increase in quantity and rate of metal ion dissolved due to electric conduction is effectively achieved. As will be demonstrated in Examples and Comparative Examples later, the quantity of metal ion dissolved or the rate of dissolving metal ion can be increased by a factor of 5 or more as compared with a simple immersion process without electric conduction.

The electrode used as a counter electrode to the soluble electrode is formed of a metal material having a nobler standard electrode potential than the soluble electrode. The metal ion dissolution rate is more effectively increased when the counter electrode is an electrode of noble metal coated on a surface with an electrode catalyst layer formed of an oxide of noble metal. Although the reason why the dissolution rate is increased by the use of such a coated counter electrode is not well understood, it is probably because the electrode has a lower hydrogen overvoltage and hence, a higher galvanic current flow.

DETAILED DESCRIPTION OF THE INVENTION

The present invention is directed to an effective method for replenishing a metal ion to a plating bath. The plating bath to which the metal ion is replenished is not particularly limited and may be either an electrodeposition bath or an electroless plating bath. The present invention is best suited for acidic tin plating baths, solder plating baths, and zinc plating baths.

In the practice of the present invention, a metal of the same type as the metal ion in the plating bath is immersed in the plating bath as a soluble electrode. If the bath is a metal plating bath containing one type of metal ion, the soluble electrode is formed of the same type of metal as that in the bath. In the case of a tin plating bath, for example, metallic tin is immersed in the bath. If the bath is an alloy plating bath containing plural types of metal ions, the soluble electrode is formed of the same type of metal as at least one of the plural types of metal ion in the bath, typically of the same types of metal as all the plural types of metal ion in the bath. In the case of a solder plating bath, for example, tin and lead in respective elemental metal forms or a tin-lead alloy is immersed in the bath. In some cases, it is possible to use only the same type of metal as one of the plural types of metal ion in the bath, for example, either one of tin and lead in the case of a solder plating bath.

The electrode used as a counter electrode to the soluble electrode is formed of a metal material having a nobler standard electrode potential than the soluble electrode. Included are electrodes formed of platinum group metals such as Pt, Ir, Os, Pd, Rh, Ru, etc. and electrodes comprising a core of titanium or the like coated with an electrode catalyst layer of a metal oxide on a surface, with the latter being preferred. The metal oxide forming the electrode catalyst layer includes oxides of Pt, Pd, Ir, Ru, Ta, Ti, Zr, Nb, Sn, etc. and mixtures of two or more, with a mixture of a base metal oxide and a noble metal oxide being preferred. Such coated electrodes are commercially available as DSE from Permelec Electrode Ltd. and MODE from Ishifuku Metals K. K.

A metal ion is replenished to the plating bath by conducting electricity between the soluble electrode and the counter electrode in the bath whereby electrolytic action takes place so that the metal is dissolved from the soluble electrode to supply its ion to the bath. According to the present invention, the deposition of the dissolving metal ion on the counter electrode is prevented by measuring the potential of the counter electrode using a reference electrode of the same metal material as the soluble electrode and controlling the quantity of electricity conducted between the soluble electrode and the counter electrode such that the measured potential may not be negative with respect to the reference electrode.

Figure 1:
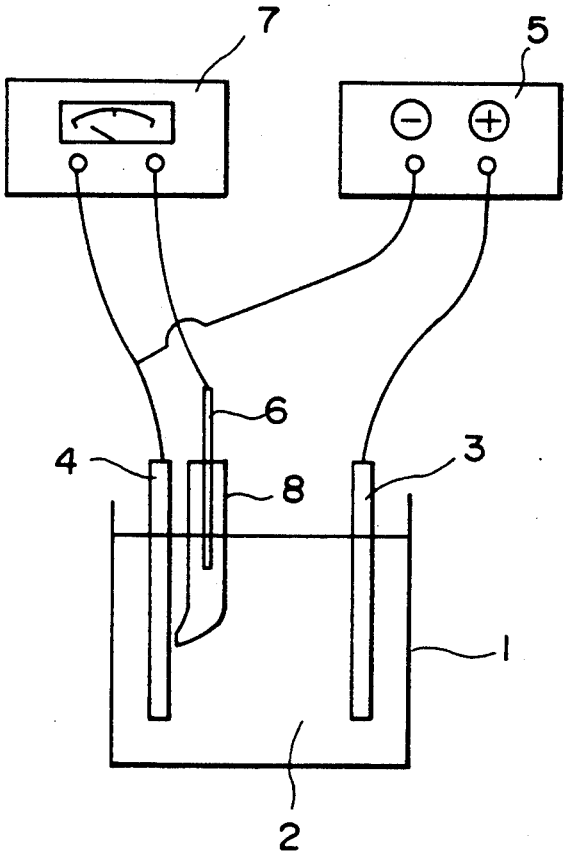
FIG. 1 schematically illustrates one preferred embodiment of the present invention for replenishing a metal ion to a plating bath.

Referring to FIG. 1, there is illustrated one preferred embodiment of the present invention for replenishing a metal ion to a plating bath. The system includes a dissolving tank 1 having a plating bath or solution 2 contained therein. A soluble electrode 3 and a counter electrode 4, both defined above, are immersed in the bath 2 and coupled to a DC supply 5 such that the soluble electrode 3 is a positive electrode and the counter electrode 4 is a negative electrode whereby electricity is conducted across the electrodes. A reference electrode 6 formed of the same material as the soluble electrode is immersed in the bath 2. A voltmeter 7 is coupled between the reference electrode 6 and the counter electrode 4 for measuring the potential of the counter electrode 4 relative to the reference electrode 6. The quantity of electricity from the DC supply 5 is controlled such that the measured potential may not be negative with respect to the reference electrode 6. It is to be noted that the reference electrode 6 is received in a Luggin tube 8 in the illustrated embodiment. The Luggin tube 8 located at its distal end in the vicinity of the surface of the counter electrode ensures precise potential measurement.

Figure 2:
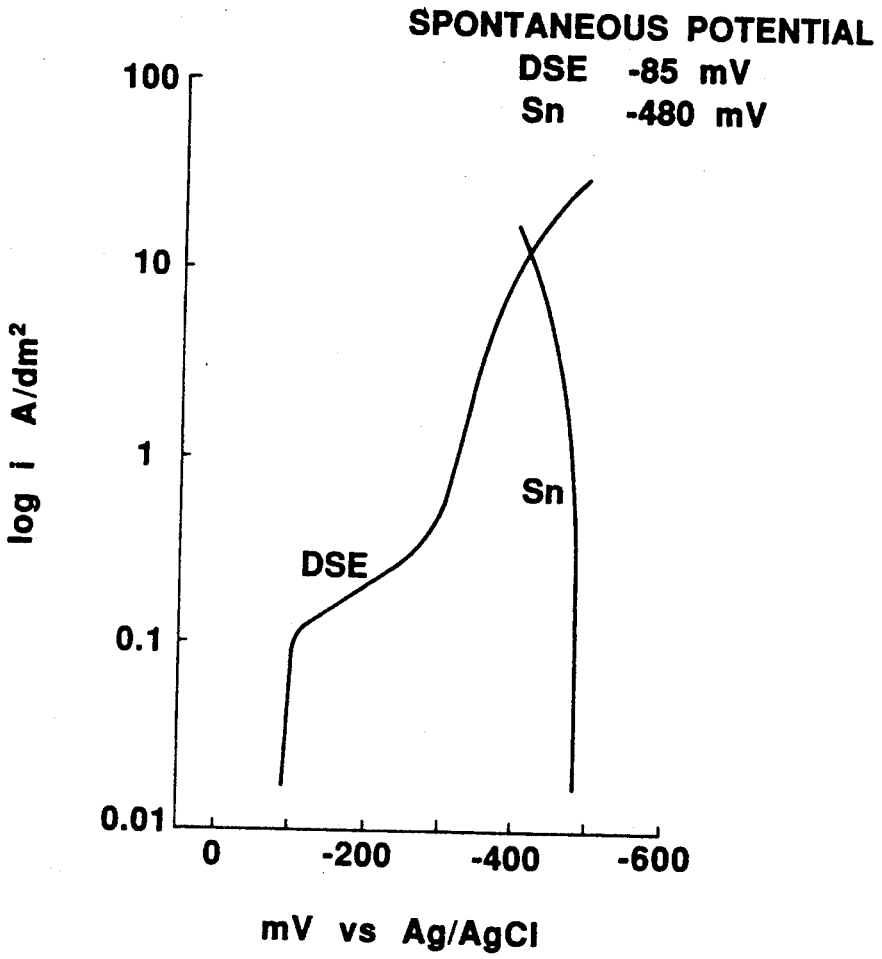
FIG. 2 is a graph showing the potential of the counter electrode as measured using a reference electrode of Ag/AgCl when electricity is conducted between the soluble electrode and the counter electrode, all the components corresponding to Example 7.

It is now described how to control the quantity of electricity. The potentials of the counter electrode and the soluble electrode are measured in accordance with the above-mentioned method while the quantity of electricity is increased. Then the potentials vary as shown in FIG. 2 which corresponds to the potential measurement of Example 7 to be described later. It is seen that as the quantity of electricity increases, the potential of the counter electrode (DSE) decreases and the potential of the soluble electrode (Sn) slowly increases. If the potential of the counter electrode (DSE) is more basic than the spontaneous potential (−480 mV) of the soluble electrode, then the counter electrode would be plated with the dissolving metal ion. Therefore, in accordance with the present invention, the potential of the counter electrode is measured using a reference electrode of the same metal material as the soluble electrode and the quantity of electricity is controlled such that the potential difference between the counter electrode and the reference electrode may not be reversed. That is, the potential of the counter electrode should not be lower than that of the reference electrode.

The soluble, counter and reference electrodes may be directly immersed in a primary plating tank where plating is actually carried out so that the desired metal ion or ions are replenished directly to the tank. Alternatively, the electrodes may be placed in a separate dissolving tank into which the plating solution is fed from the primary plating tank. After the metal ion or ions are replenished in the dissolving tank, the plating solution is fed back to the primary plating tank. In the embodiment wherein such a subordinate dissolving tank is provided, the present invention can reduce the volume of the dissolving tank because of the increased amount of metal dissolved or increased dissolution rate, allowing for the use of a compact dissolving tank.

EXAMPLE

Examples of the present invention are given below by way of illustration and not by way of limitation.

EXAMPLE 1

In a tin plating bath containing 40 gram/liter of $SnSO_4$ and 150 gram/liter of $H_2SO_4$ were immersed a metallic tin electrode having a surface area of 1 $dm^2$, a counter electrode of metallic titanium covered with a platinum group metal oxide coating having a surface area of 1 $dm^2$ (DSE manufactured by Permelec Electrode Ltd.), and a reference electrode of metallic tin received in a Luggin tube. The metallic tin electrode and the DSE electrode were connected across a DC supply. The DSE electrode and the reference electrode were connected across a voltmeter. There was completed a dissolving tank system as shown in FIG. 1.

Electricity was conducted from the DC supply across the metallic tin electrode and the DSE electrode. The quantity of electricity was controlled such that the potential of the DSE electrode as measured by the voltmeter might not become negative relative to the reference electrode.

Tin was dissolved out from the metallic tin electrode at an average rate of 2.5 gram/liter/hour/$dm^2$. No deposition of a tin film was observed on the DSE electrode.

Comparative Example 1

As in Example 1, a metallic tin electrode and a DSE electrode were immersed in a tin plating bath. The electrodes were electrically connected. Although the metallic tin electrode was found to have partially dissolved away, the average tin dissolution rate was 0.5 gram/liter/hour/$dm^2$ which was about 1/5 of that of Example Example 2

In a solder plating bath containing 45 gram/liter of $Sn^{2+}$, 5 gram/liter of $Pb^{2+}$ and 100 gram/liter of alkane-sulfonic acid were immersed a solder (Sn/Pb=9/1) electrode having a surface area of 1 $dm^2$, a DSE electrode having a surface area of 1 $dm^2$ (as in Example 1), and a reference electrode of the same solder. Electricity was conducted between the solder electrode and the DSE electrode as in Example 1

The average dissolution rate was 2.5 gram/liter/hour/$dm^2$ for tin and 0.25 gram/liter/hour/$dm^2$ for lead. No deposit was observed on the DSE electrode.

Comparative Example 2

As in Example 2, a solder electrode and a DSE electrode were immersed in a solder plating bath. The electrodes were electrically connected. Although the dissolution of tin and lead was observed, the average dissolution rate was 0.5 gram/liter/hour/$dm^2$ for tin and 0.5 gram/liter/hour/$dm^2$ for lead which were about 1/5 of those of Example 2.

Example 3

In a zinc plating bath-containing 40 gram/liter of $ZnCl_2$ and 200 gram/liter of $NH_4Cl$ were immersed a metallic zinc electrode having a surface area of 1 $dm^2$, a DSE electrode having a surface area of 1 $dm^2$ (as in Example 1), and a reference electrode of metallic zinc. Electricity was conducted between the zinc electrode and the DSE electrode as in Example 1.

The average zinc dissolution rate was 3.5 gram/liter/hour/$dm^2$. No deposit was observed on the DSE electrode.

Comparative Example 3

As in Example 3, a metallic zinc electrode and a DSE electrode were immersed in a zinc plating bath. The electrodes were electrically connected. Altough the dissolution of zinc was observed, the average zinc dissolution rate was 0.7 gram/liter/hour/$dm^2$ which was about 1/5 of that of Example 3.

Example 4

The zinc plating bath used was of the composition:

| | |
|---|---|
| zinc sulfate | 450 gram/liter |
| aluminum sulfate | 10 gram/liter |
| sodium chloride | 30 gram/liter |
| boric acid | 30 gram/liter |
| pH | 1.5. |

A metallic zinc electrode having a surface are of 1 $dm^2$, a DSE electrode having a surface area of 1 $dm^2$ (as in Example 1), and a reference electrode of metallic zinc were immersed in the bath. Electricity was conducted between the zinc electrode and the DSE electrode as in Example 1.

The average zinc dissolution rate was 12.5 gram/liter/hour/$dm^2$.

Example 5

The zinc plating bath used was of the composition:

| | |
|---|---|
| metallic zinc | 10 gram/liter |
| sodium hydroxide | 120 gram/liter |
| additive | 10 ml/liter |

(the additive is commercially available as Nuzin SRi from C. Uyemura & Co., Ltd.). A metallic zinc electrode having a surface area of 1 $dm^2$, a DSE electrode having a surface area of 1 $dm^2$ (as in Example 1), and a reference electrode of metallic zinc were immersed in the bath. Electricity was conducted between the zinc electrode and the DSE electrode as in Example 1.

The average zinc dissolution rate was 5.0 gram/liter/hour/$dm^2$.

Example 6

The copper plating bath used was of the composition:

| | |
|---|---|
| copper sulfate | 200 gram/liter |
| sulfuric acid | 30 gram/liter |
| Levco EX | 10 ml/liter |

(Levco EX is commercially available from C. Uyemura & Co., Ltd.). A metallic copper electrode having a surface area of 1 $dm^2$, a DSE electrode having a surface area of 1 $dm^2$ (as in Example 1), and a reference electrode of metallic copper were immersed in the bath. Electricity was conducted between the copper electrode and the DSE electrode as in Example 1.

The average copper dissolution rate was 5.0 gram/liter/hour/$dm^2$.

Example 7

The electroless solder plating bath used was of the composition:

| | |
|---|---|
| methanesulfonic acid | 50 gram/liter |
| tin methanesulfonate | 20 gram/liter |
| lead methanesulfonate | 13 gram/liter |
| thiourea | 75 gram/liter |
| sodium hypophosphite | 80 gram/liter |
| citric acid | 15 gram/liter |
| lauryl pyridinium chloride | 5 gram/liter |
| EDTA | 3 gram/liter |
| pH | 2.0. |

A metallic tin electrode having a surface area of 1 $dm^2$, a DSE electrode having a surface area of 1 $dm^2$ (as in Example 1), and a reference electrode of metallic tin were immersed in the bath. Electricity was conducted between the metallic tin electrode and the DSE electrode. The potential of the DSE electrode (mV vs Ag/AgCl on the abscissa) was plotted in FIG. 2 as a function of electricity quantity (logi on the ordinate, i in A/$dm^2$).

When the quantity of electricity was controlled as in Example 1, the average tin dissolution rate was 3.5 gram/liter/hour/$dm^2$.

Separately, a metallic lead electrode having a surface area of 1 $dm^2$, a DSE electrode having a surface area of 1 $dm^2$ (as in Example 1), and a reference electrode of metallic lead were immersed in the same bath as above. Electricity was conducted between the metallic lead electrode and the DSE electrode as in Example 1.

The average lead dissolution rate was 2.5 gram/-liter/hour/$dm^2$.

There has been described the replenishment of a metal ion to a plating bath by conducting electricity between a soluble electrode and a counter electrode in the bath wherein deposition of the dissolving meal ion on the counter electrode is prevented by controlling the quantity of electricity such that the potential of the counter electrode may be higher than the potential of the same metal as the soluble electrode. This control increases the rate of metal dissolving from the soluble electrode to achieve an effective supply of metal ion to the bath.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for replenishing the one or at least one of the plural types of metal ions in a plating bath containing one or plural types of said metals comprising the steps of:

immersing in the bath a soluble electrode of the same type of metal as the one in the bath or at least one of the plural types of metal ions in the bath and a counter electrode of a metal material having a nobler standard electrode potential than said soluble electrode, conducting electricity between said soluble electrode and said counter electrode, thereby dissolving said soluble electrode to replenish an ion of the metal of said soluble electrode to the bath, measuring the potential of the counter electrode using a reference electrode of the same metal as the soluble electrode, and controlling the quantity of electricity conducted between said soluble electrode and said counter electrode such that the measured potential may not be negative with respect to said reference electrode, thereby preventing deposition of the dissolving metal ion on said counter electrode.

2. The method of claim 1 wherein said counter electrode is an electrode coated on a surface with an electrode catalyst layer formed of a metal oxide.

* * * * *